US006948543B1

(12) United States Patent
Sans Folch

(10) Patent No.: US 6,948,543 B1
(45) Date of Patent: Sep. 27, 2005

(54) ASSEMBLY FOR RETAINING A LOUVER OF A VERTICAL BLIND ASSEMBLY IN AN OPERATIVE POSITION

(76) Inventor: Jose Maria Sans Folch, Muralla De Santa Tecla, 27, Montblanc (Tarragona) (ES)

( * ) Notice: Subject to any disclaimer, the term of this patent is extended or adjusted under 35 U.S.C. 154(b) by 0 days.

(21) Appl. No.: 10/643,807

(22) Filed: Aug. 19, 2003

(51) Int. Cl.[7] ..... E06B 9/34
(52) U.S. Cl. ..... 160/168.1 V; 160/178.1 V
(58) Field of Search ..... 160/173 V, 177 V, 160/176.1 V, 168.1 V, 178.1 V, 900; 24/542

(56) References Cited

U.S. PATENT DOCUMENTS 4,116,257 A * 9/1978 Bratschi ..... 160/168.1 R
4,291,738 A * 9/1981 Grenga et al. ..... 160/176.1 R
4,356,855 A * 11/1982 Holzer ..... 160/178.1 R
4,566,157 A * 1/1986 Packendorff ..... 24/536
4,648,436 A * 3/1987 Oskam ..... 160/168.1 V
4,716,634 A * 1/1988 Fan ..... 24/545
5,094,287 A * 3/1992 Vargas et al. ..... 160/178.1 V
5,168,913 A * 12/1992 Haines ..... 160/168.1 R
5,257,811 A * 11/1993 Biba ..... 160/168.1 V
5,289,863 A * 3/1994 Schon ..... 160/168.1 R
6,450,234 B2 * 9/2002 Welfonder ..... 160/178.1 V

* cited by examiner

*Primary Examiner*—Blair M. Johnson
(74) *Attorney, Agent, or Firm*—Malloy & Malloy, P.A.

(57) ABSTRACT

An assembly structured to securely maintain a louver of a vertical blind assembly in an intended, operative position comprising a support plate secured to and/or defining an upper end of the louver and a retaining clip. The support plate and remainder of the louver are connected in depending, supported relation to a connecting portion of a carrier assembly of the vertical blind assembly. The retaining clip, when in its operative position is disposed in surrounding, substantially clamping engagement with the connecting portion, thereby assuring a secure suspended support of the louver on a corresponding one of the carrier assemblies.

24 Claims, 11 Drawing Sheets

ASSEMBLY FOR RETAINING A LOUVER OF A VERTICAL BLIND ASSEMBLY IN AN OPERATIVE POSITION

BACKGROUND OF THE INVENTION

1. Field of the Invention

This invention relates to an assembly structured to maintain a secure engagement between a louver and an associated carrier assembly of a vertical blind assembly and includes a support plate connected to and/or defining an upper end of the louver. A retaining clip is removably disposed in clamping engagement with anyone of a plurality of different types of connecting portions associated with the carrier assembly such that attachment between the connecting portion and the support plate is securely maintained.

2. Description of the Related Art

Use of vertical blind assemblies to cover windows, sliding doors, etc. has gained wide popularity over the last few years. Conventionally structured vertical blind assemblies normally include a header having an elongated configuration of sufficient length to extend along the upper periphery of the window, door, etc. intended to be covered. The header includes an interior track extending along substantially the entire length thereof and a plurality of carrier assemblies, at least equal in number to the number of louvers, blinds, vanes, etc. associated with the vertical blind assembly. Each of the carrier assemblies include structural features which facilitate easy passage thereof, as well as the louver or blind attached thereto, along the length of the track. A connecting portion is movably connected to each of the carrier assemblies and extends downwardly therefrom to an exterior of the header and in supporting engagement with a corresponding one of louvers.

The structural and operative features of each carrier assembly and associated connecting portion is such as to facilitate movement thereof, and the louver supported thereby, along the length of the track of the header assembly, as set forth above. In addition, each of the carrier assemblies are connected to a "tilt rod" also extending along the length of the header assembly and rotatably connected to mechanical linkage of each of the carrier assemblies so as to facilitate selective turning or tilting, in a concurrent, simultaneous fashion, of each of the louvers. Therefore, in typical fashion the plurality of louvers may extend along any portion of the length of the header in overlying relation to the corresponding door, window, etc. and/or be concurrently disposed into any type of slanted or tilted orientation so as to regulate the amount of light passing through the portal. Admittedly, vertical blind assemblies of the type generally described above include distinguishing structural features depending, at least in part, on a particular application for which a vertical blind assembly is intended. In addition, the vertical blind industry is replete with structurally modified components designed to improve the efficiency of the various types of vertical blind assemblies conventionally known and/or commercially available. Efforts to improve vertical blind assemblies include structural variations in the carrier assembly, connecting portion, track configuration, tilt rod, and selectively operable controls for regulating the position and orientation of the plurality of louvers or blinds associated with the vertical blind assembly.

By way of example, the structure of the various known carrier assemblies and their corresponding connecting portions may differ significantly. Common to a majority of such carrier assemblies and connecting portions is the ability of the connecting portion to be removably secured to an upper supporting end of a corresponding one of the louvers to which it is intended to be connected. Removable attachment between the connecting portion and the louver is provided to facilitate an effective connection there between while allowing quick and easy removal of individual ones of the louvers for repair or replacement. However, one disadvantage associated with the conventional manner of interconnecting the upper end of the louver to the connecting portion is the tendency for the louvers to become easily detached therefrom. Such undesirable detachment is particularly prevalent when the collection of louvers or blinds are forced along the length of the track and header assembly in a brisk manner, while a user simultaneously attempts to change the tilted or slanted orientation thereof.

Other factors commonly affecting the stability of the interconnection between the connecting portion and the individual louvers is the weight, configuration and overall structure of the louver. By way of example only, a louver may be formed, at least in part, from heavy material components such as decorative chain links disposed in depending relation from and supported by a support structure disclosed adjacent an upper most end of the louver. Accordingly, when the aforementioned support portion is removably secured to anyone of a plurality of different types of connecting portions, the weight of the louver or blind may be such as to facilitate its detachment from the connection portion. Such inadvertent detachment is also common when the louver is subjected to unusual forces, such as engagement with people or objects, exposure to wind gusts, or rapid and simultaneous movement and tilting of the louvers through operation of the controls of the vertical blind assembly.

Therefore, there is a significant and long recognized need in the vertical blind industry for an assembly which securely and consistently maintains a supporting interconnection of the connecting portion and individual louvers or blinds associated with the vertical blind assembly. Such an improved retaining assembly should be structured to not interfere with the normal operation of the vertical blind assembly, especially in terms of the collective movement of the louvers or blinds relative to the header assembly and track structure associated therewith. In addition, an improved retainer assembly of the type needed to overcome known disadvantages and problems of the type set forth above should have sufficient structural and operative versatility to be used with any of the different types of connecting structures known or commercially available, especially when such a large number of structurally distinguishable connecting structures are prevalently used in the vertical blind industry.

SUMMARY OF THE INVENTION

The present invention relates to an assembly structured to maintain a secure attachment between individual louvers, blinds, vanes, etc. and corresponding carrier assemblies associated with a vertical blind assembly. The term louver as repeatedly referred to herein is meant to be representative of any of a large category of vertically oriented and suspended flats, vanes, blinds or like members of the type typically associated with a vertical blind assembly. In addition, the retaining assembly of the present invention is not intended to be limited to the secure interconnection and support of the individual louvers, but may also be utilized to secure the interconnection and support of curtain structures and/or components thereof. Therefore, when the structural and operative components of the retaining assembly of the present invention are described with reference to the support of individual louvers to the connecting portion of a carrier assembly, the same structural and operative components may be utilized to support an appropriately structured curtain assembly, without departing from the intended spirit and scope of the present invention.

Therefore, the retainer assembly of the present invention comprises a support portion, preferably in the form of an elongated support plate mounted on or connected to an upper most end of a louver. As such, the support plate may be considered a component of the louver and/or an independent structure therefrom. In either case the support plate, rather than the remaining structure of the louver, is considered a part of the present invention. Also, interconnection between the support plate and the remainder of the louver will be dependent on the overall structure of the louver itself. By way of example only, the louver may comprise a plurality of decorative chain links comprising independent strands or lengths having one end movably or fixedly secured to the support plate and depending therefrom in a suspended orientation. Individual strands may be connected or separated from one another and may be formed from a variety of different materials.

Moreover, one advantage in using the retaining assembly of the present invention is the ability to make the remaining structure of the louver, other than the support plate, from a variety of different materials. Further, such materials may be relatively heavy when compared to a conventional louver, of the type known in the vertical blind industry.

Other structural features of the support plate include an outwardly extending finger or protruding nub integrally or otherwise fixedly secured to an upper periphery of the support plate to facilitate engagement with the aforementioned depending connecting portion of an associated carrier assembly. Moreover, the outwardly extending finger has a mounting aperture formed therein such that a supporting hook or other equivalent structure typically found on various types of connecting portions at least partially passes there through and thereby facilitates connection to the support plate. Again, in many instances it is desirable to structure the connecting portion to facilitate a removable connection of the individual louvers thereto. However, as emphasized above, the ability to removably connect the individual louvers to the respective connecting portions also results in an increased possibility of inadvertent detachment of the louvers from the connecting portion.

Detachment may also occur because of a lateral displacement of the support plate relative to the connecting portion such as when the louver is being tilted or turned about the axes of the connecting portion. Therefore, the support plate of the present invention also includes a stabilizing assembly mounted thereon and disposed to engage or be positioned in immediate adjacent or contiguous relation to the two peripheral portions of the mounting aperture. The disposition and structure of the stabilizing assembly is such as to prevent or significantly restrict excessive lateral movement of the connecting portion relative to the support plate and in particular the outer protruding finger in which the mounting aperture is formed.

Other structural features of the retaining assembly of the present invention include a retaining clip removably secured in retaining relation to the connecting portion and in direct cooperation with the support plate. Moreover, the retaining clip may be removably secured in clamping engagement with opposite parts of the connecting portion so as to securely and efficiently maintain the connecting portion in its supported attachment to the support plate and at least partially within the mounting aperture. As such, the retaining clip is preferably formed of an integral, one-piece construction of flexible material having an at least minimal inherent bias. Further, the retaining clip includes an open interior and at least one access opening disposed and dimensioned to allow passage of the connecting portion and the outwardly extending finger of the support plate there through into the open interior.

An interior surface is formed within the open interior of the clip and includes spaced apart retaining surface segments. The surface segments are substantially opposed relative to one another and overly and/or engage opposite sides of the outwardly extending finger as well as the mounting aperture formed therein. In addition, at least a portion of the interior surface is configured to receive and securely engage an exposed part of the connecting portion. More specifically, in at least one preferred embodiment of the present invention, the configuration of at least one of the surface segments includes a recessed portion disposed, dimensioned and configured to at least partially receive an exterior part of the connecting portion. The recessed configuration of the surface segment thereby serves to at least partially "capture" or retain a corresponding exterior part of the connecting portion therein. Inadvertent lateral or other directional displacement of the retaining clip from its clamping engagement with the connecting portion of the carrier assembly is thereby prevented or significantly restricted.

Therefore, it should be apparent that the retaining assembly of the present invention, including the structural and functional features of the support plate and the cooperatively disposed retaining clip, are such as to overcome many of the problems and disadvantages associated with the unintended and inadvertent detachment of the plurality of louvers, vanes or blinds from their respective carrier assemblies. Also, the support plate and retaining clip are structured to be utilized with any of a wide variety of different types of connecting portions, each of which may be structurally distinguishable from one another, wherein a common purpose of all the different connecting portions is the supporting attachment thereof to a corresponding louver, vane, blind, etc.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
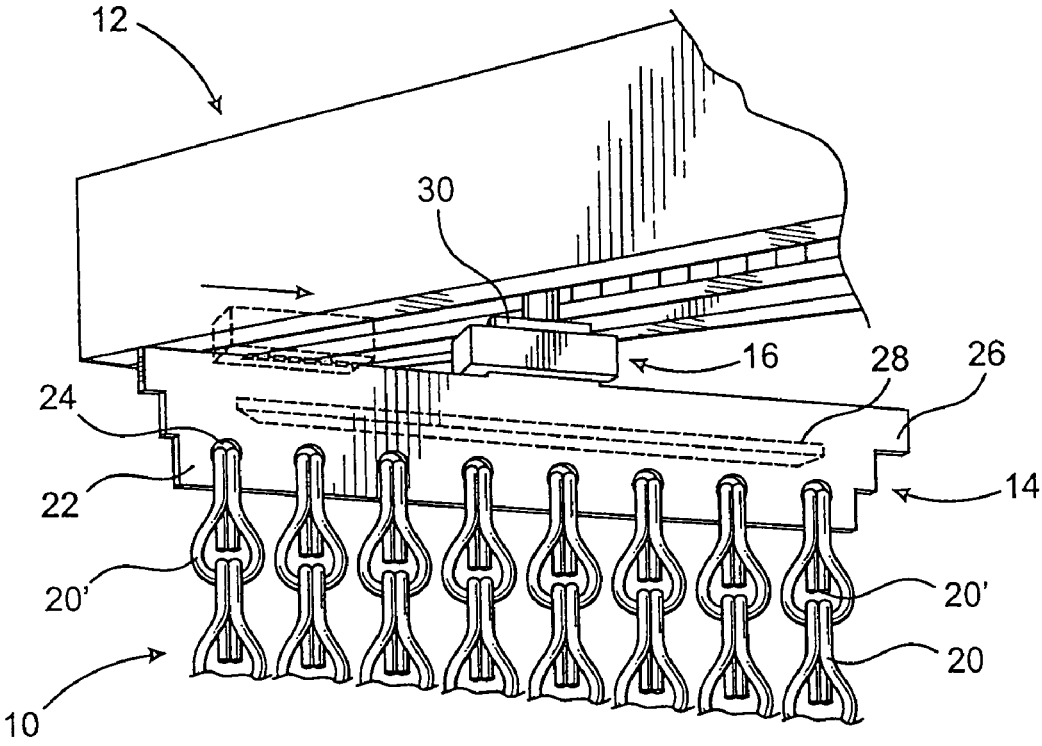
FIG. 1 is a perspective view in partial cutaway of a vertical blind assembly including a retaining clip and a support plate of the present invention.

As shown in the accompanying drawings, the present invention is directed to an assembly for securely but removably retaining a louver, blind, vane, etc, generally indicated as 10, in an operative, suspended position from a header assembly generally indicated as 12 of a vertical blind assembly represented in FIG. 1.

More specifically, the assembly of the present invention comprises a support plate generally indicated as 14 and a retaining clip generally indicated as 16. A most preferred embodiment of the assembly of the present invention including support plate 14 and the retaining clip 16 will be described with reference to the secure retention of the louver 10 in its operative position. However, it is emphasized that the specific structure of the louver may vary greatly from that represented in the various accompanying Figures. Similarly, the various structural components of the vertical blind assembly such as, but not limited to, the structural features of the carrier assembly (not shown for purposes of clarity) and accompanying connecting portion associated therewith may also vary significantly. Moreover, it is recognized in the vertical blind industry that a variety of different connecting portions are available to support individual louvers, blinds, vanes, etc. from the individual carrier assemblies and from the header assembly 12. Accordingly, the structural and functional versatility of the assembly of the present invention facilitates its use with any one of a large number of connecting portions each of which, while being structurally distinguishable from one another, serve to support individual louvers from the header assembly 12 in a similar manner. Therefore, a plurality of different connecting portions presented in the accompanying Figures will each be indicated by a separate reference numeral.

Figure 2:
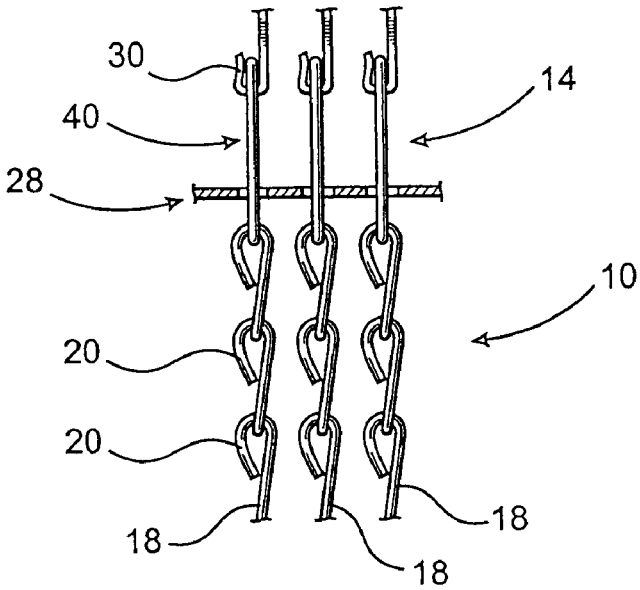
FIG. 2 is a side view of a portion of the embodiment of FIG. 1 in partial cutaway showing relative positions of the support plate absent the retaining clip connected thereto.
Figure 3:
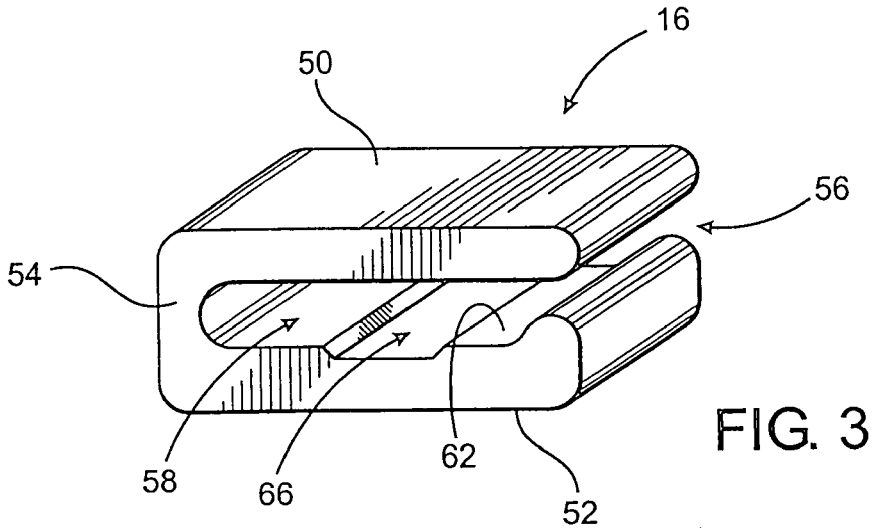
FIG. 3 is a perspective view of the retaining clip of the embodiment of FIG. 1.
Figure 4:
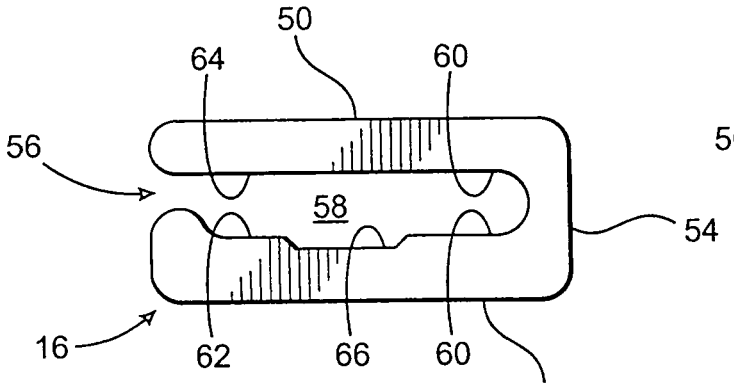
FIG. 4 is a rear view of the embodiment of FIG. 3.
Figure 5:
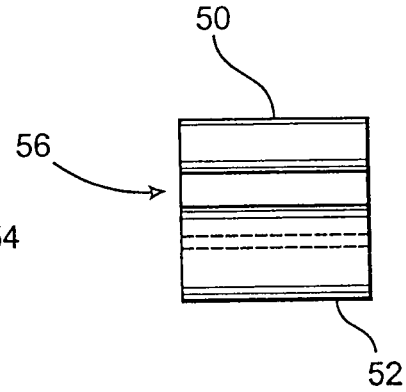
FIG. 5 is an end view showing an access opening of the embodiment of FIGS. 3 and 4.
Figure 6:
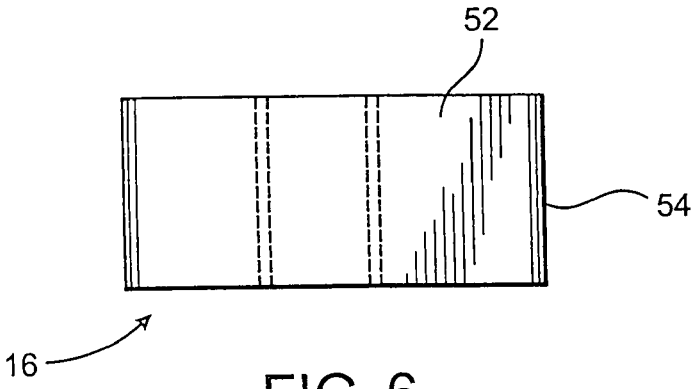
FIG. 6 is a bottom view of the embodiments of FIGS. 3 through 5.
Figure 8:
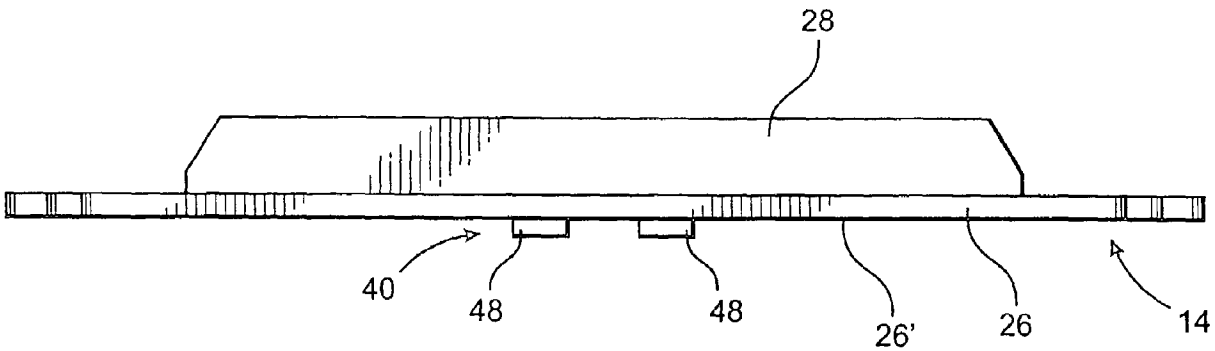
FIG. 8 is a top view of the embodiment of FIG. 7.
Figure 7:
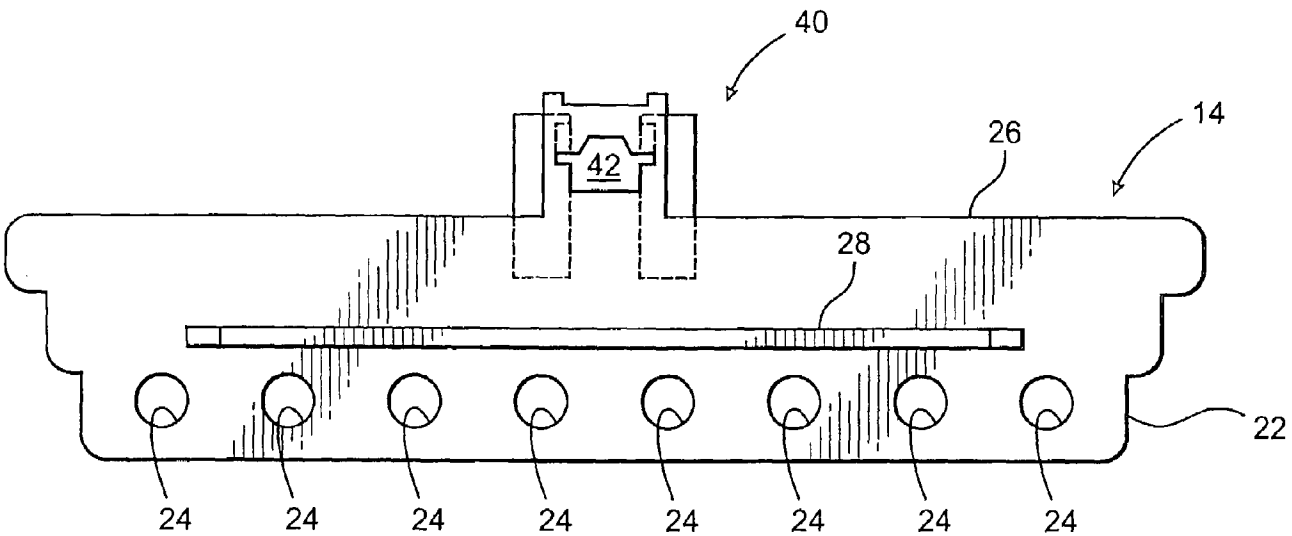
FIG. 7 is a rear view of the support plate of the present invention.
Figure 10:
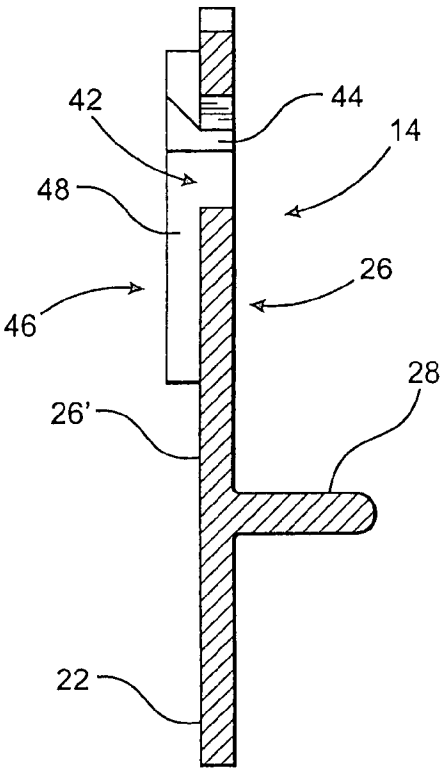
FIG. 10 is a sectional view along line 10—10 of FIG. 9.
Figure 9:
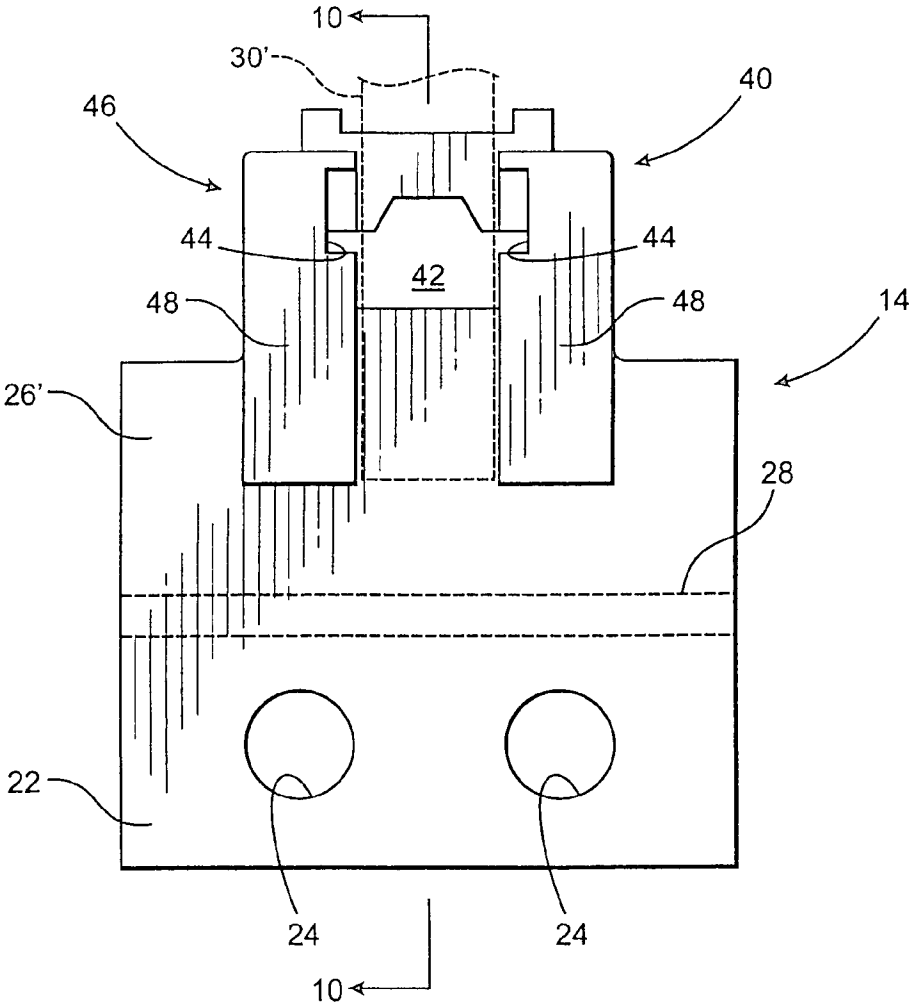
FIG. 9 is a detailed view in partial cutaway of a front portion of the support plate of the embodiment of FIGS. 7 and 8.

Also, with primary reference to FIGS. 1 and 2 the structure of the remainder of the louver 10, as distinguished from the support plate 14, comprises a plurality of elongated linked chains or strands 18 wherein each of the individual links 20 are movably secured to next adjacent links of a respective strand or length 18. Further, the upper most end links as at 20' are each secured to a lower peripheral or border portion 22 of the support plate 14 through the provision of a plurality of apertures 24 formed therein as demonstrated in FIG. 1. The individual links 20 and accordingly the remainder of the louver 10 may be formed from a variety of different materials. However, when formed from metal or other relatively heavy material the advantage of utilizing the retaining assembly of the present invention, including the support plate 14 and the retaining clip 16 is obviously beneficial, as set forth in greater detail hereinafter.

It is also emphasized that the specific structure of the louver 10, other than the support plate 14, may vary significantly from the plurality of elongated strands of linked chains or similar structure. Further, the support plate 14 is located on an upper most end of the louver 10 and, dependant upon the specific structural features of the remainder of the louver 10, the support plate 14 may or may not be considered an integrated part of the louver 10. Regardless, the retaining assembly of the present invention comprises the support plate 14 and the retaining clip 16 separate and apart from the remaining structure of the louver 10 depending from and supported by the support plate 14.

Other structural features of the support plate 14 are clearly represented in FIGS. 2 and 7 through 10. As disclosed, the support plate 14 preferably includes an elongated body 26 formed of a substantially rigid material having sufficient strength to support a remainder of the louver 10 in depending relation therefrom. A spacer member 28 is formed on and extends outwardly from one surface of the support plate 14 a sufficient and/or predetermined distance to facilitate a desired spacing between the individual louvers 10 when they are disposed in adjacent relation to one another, as demonstrated in FIG. 2. Naturally, the length of the spacer structure 28 and the distance it extends outwardly from the body 26 may vary so as to correspondingly vary the intended or predetermined spacing between the louvers 10 when arranged in adjacent relation to one another.

As set forth above, the support plate 14 is intended to be supported in a downwardly suspended relation from the connecting portion 30 of a corresponding carrier assembly. As will be described in greater detail hereinafter with regard to various ones of the accompanying Figures, the structural features of the different types of connecting portions may vary. However, common to all, or at least a majority of the connecting portions are structural features which facilitate their supporting and preferably removable attachment to the support plate 14. To accomplish such removable attachment, the support plate 14 includes an outwardly extending mounting finger generally indicated as 40. The mounting finger 40 also includes a mounting aperture 42 through which an engaging member of the connecting portion 30, or other type of connecting portion, at least partially passes. As such, the mounting aperture 42 may include grooves or channels 44 to accommodate the different structures of the connecting portions as will be further described.

Although not shown in all of the accompanying Figures, a most preferred embodiment of the support plate 14 includes the provision of a stabilizing assembly 46 including at least one but preferably two, spaced apart stop member 48 formed on at least one side surface, as at 26', of the body 26 and extending outwardly therefrom. Further, each of the stop members 48 are disposed immediately adjacent or contiguous to oppositely dispose peripheral portions of the mounting aperture 42. As such, the stop members 48 are disposed in spaced apart relation to one another a distance sufficient to permit the disposition there between of an engaging member 30' of the connecting portion 30. For purposes of clarity, the positioning of the engaging member 30' of the connecting portion 30 is represented in phantom lines in FIG. 9 and in full lines in FIG. 11. It is again emphasized that the various connecting portions may very well be structurally distinguishable. Therefore regardless of its configuration, the engaging member 30' of the connecting portion 30 is disposable between and in contained relation to the stop members 48. However, the outward extension of the stop members 48 from the corresponding surface 26' and their close proximity to the periphery of the mounting aperture 42 eliminates or significantly restricts any undesirable lateral displacement between the engagement member 30' and the support plate 14 as well as the inadvertent detachment of the engaging member 30' from the mounting aperture 42. Such lateral displacement is undesirable in that it will further facilitate the inadvertent detachment of the support plate 14 and the remainder of the louver 10 from its intended suspended and supported position relative to the connecting portion 30 and its respective carrier assembly.

With primary reference to FIGS. 3 through 6 and 22, another feature of the retaining assembly of the present invention includes the aforementioned retaining clip 16. As disclosed, the retaining clip 16 preferably includes an integral or one piece construction having opposite sides 50 and 52 disposed in spaced, substantially opposing relation to one anther and being interconnected by a bridge portion 54 located substantially at one end of the clip 16. An access opening generally indicated as 56 is located opposite to the bridge 54 and is disposed in communicating relation with an open interior 58. The retaining clip 16 is preferably formed from a flexible material comprising at least a minimal inherent bias. As such, the access opening 56 is disposed and cooperatively dimensioned relative to the sides 50 and 52 so as to allow an outward flexing or expansion of the sides 50 and 52. Such flexibility allows the passage of various types of connecting portions, such as 30 to pass through the access opening 56 into the open interior 58. Due to the aforementioned inherent bias, the retaining clip 16 will attempt to assume its normal or original configuration, wherein the connection portion 30 is sandwiched within the open interior 58 and between the sides 50 and 52.

Figure 13:
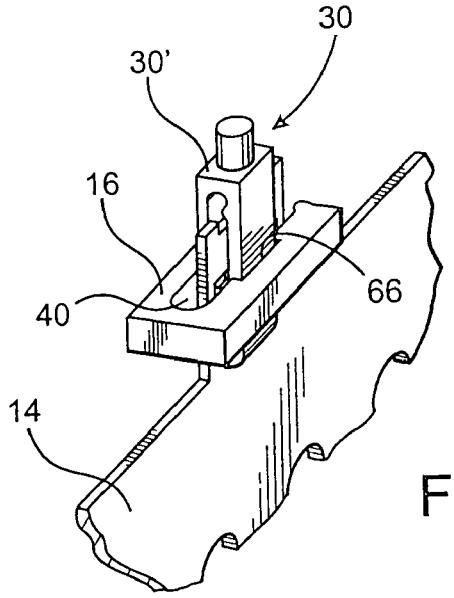
FIG. 13 is an assembled view of the retaining clip and support plate attached to the connecting portion of the carrier assembly, all in an operative position.

As further demonstrated, the retaining clip 16 also includes an interior surface 60 extending substantially continuously about the interior portions of the sides 50 and 52 as well as the bridge 54. As such, the interior surface 60 includes at least two surface segments 62 an 64. In order to further facilitate retaining engagement of the retaining clip 16 in at least partially surrounding and clamping engagement with any one of the connecting portions such as at 30, the interior surface 60 and more specifically at least one of the surface segments 62 include a substantially recessed configuration as at 66. The recessed configuration 66 of the surface segment 62 is disposed, dimensioned and configured to receive at least one part of any one of the connecting portions with which it is used. As shown in FIG. 13 the recessed configuration 66 receives an exposed part of the engaging member 30' on one side of the support plate 14. The recessed configuration 66 thereby further restricts inadvertent and undesirable lateral displacement of the retaining clip 16 relative to any of the connecting portions, to be described in greater detail hereinafter. In its operative position as shown in FIGS. 1 and 13, the opposite sides 50 and 52 are located on opposite sides of the connection portion 30, as well as on opposite sides of the support plate 14 and specifically in clamping, sandwiching relation to the connecting portion 30 and the engaging member 30' associated therewith.

Figure 11:
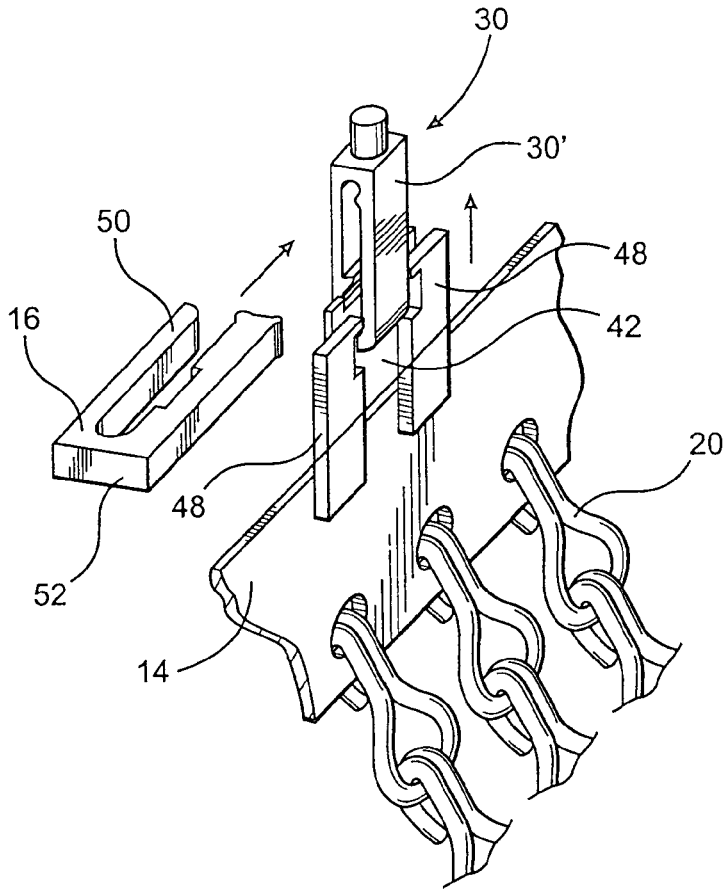
FIG. 11 is a perspective view in partial cutaway and exploded form disclosing the relative positions, immediately prior to assembly, of the retaining clip and support plate relative to a connecting portion of a carrier assembly of a vertical blind assembly of the type disclosed in FIG. 1.
Figure 12:
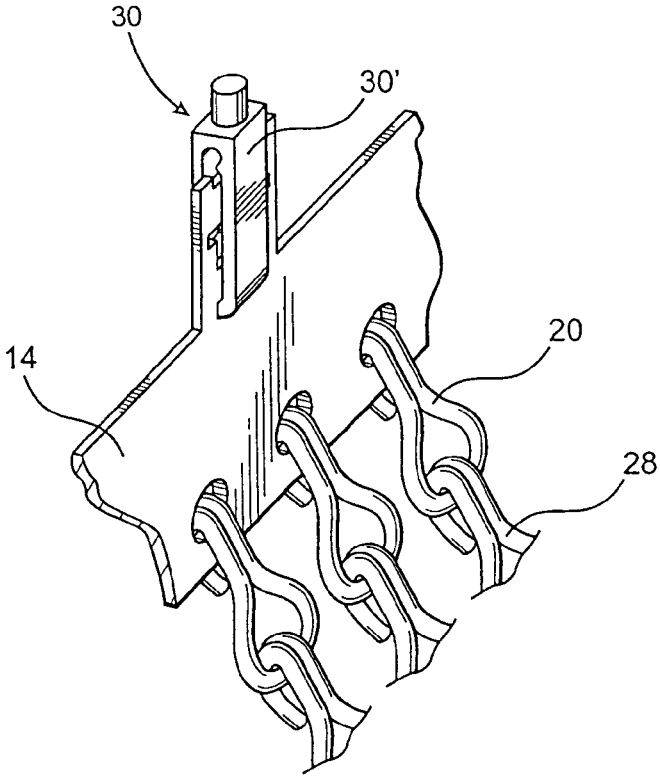
FIG. 12 is a perspective view in partial cutaway of the support plate of the present invention secured in depending, supported relation to the connecting portion of the carrier assembly.

As set forth above, the structural and functional versatility of the retaining assembly of the present invention is demonstrated by virtue of the support plate 14 and the retaining clip 16 being adapted for use with any of a variety of different connecting portions, all of which operate in a similar or substantially identical fashion in terms of supporting the individual louvers 10 in their intended, suspended position. As previously described with reference to FIGS. 1, 9 and 11 through 13, one type of connecting portion is indicated as 30. Connecting portion 30 includes the engaging member 30' which fits over the mounting finger 40 and passes at least partially through the mounting aperture 42 formed therein. As shown in FIG. 11 the retaining clip 16 is applied in retaining, clamping engagement to the connecting portion 30 as indicated by a corresponding directional arrow. Similarly, the connecting portion 30 is secured to the support plate 14 as indicated by the other directional arrow of FIG. 11. Once the connecting portion 30 is disposed in supporting relation to the support plate 14, the retaining clip 16 is applied in its operative, clamping engagement relative to the connector portion 30 and the engaging member 30' as indicated in FIG. 13.

Figure 14:
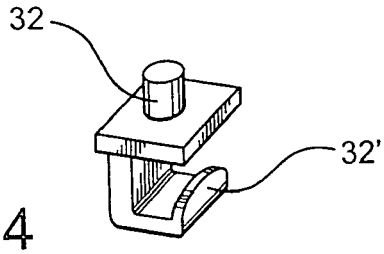
FIG. 14 is a perspective view in partial cutaway of one of a plurality of connecting portions with which the retaining clip and support plate of the present invention may be utilized.
Figure 15:
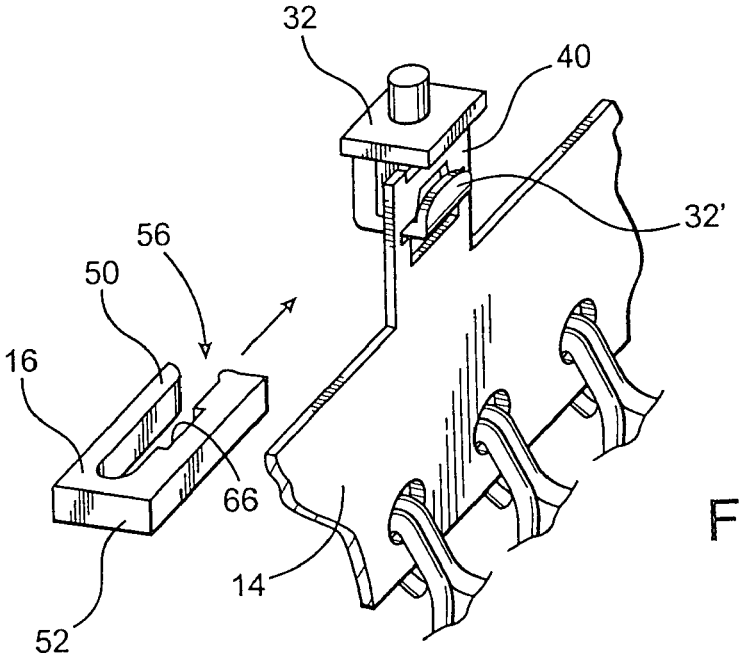
FIG. 15 is a perspective view in partial cutaway of the retaining clip and support plate of the present invention mounted on the connecting portion of FIG. 14.

FIGS. 14 and 15 represent yet another type of connecting portion 32 being structurally distinguishable from the connecting portion 30. More specifically, connecting portion 32 includes an outwardly extending hook like engaging member 32' which passes through the mounting aperture 42 of the finger 40 in the manner described above. Once the support plate 14 is mounted on the connecting portion 32 as represented in FIG. 15, the retaining clip 16 is applied in at least partially surrounding, clamping engagement to the connecting portion 32 and the engaging member 32' by forcing the connecting portion 32 through the access opening 56 as also indicated by the included directional arrow.

Figure 16:
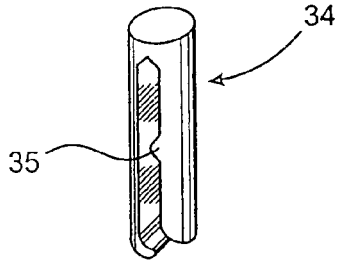
FIG. 16 is yet another structural variation of a connecting portion with which the retaining clip and support plate of the present invention may be utilized.
Figure 17:
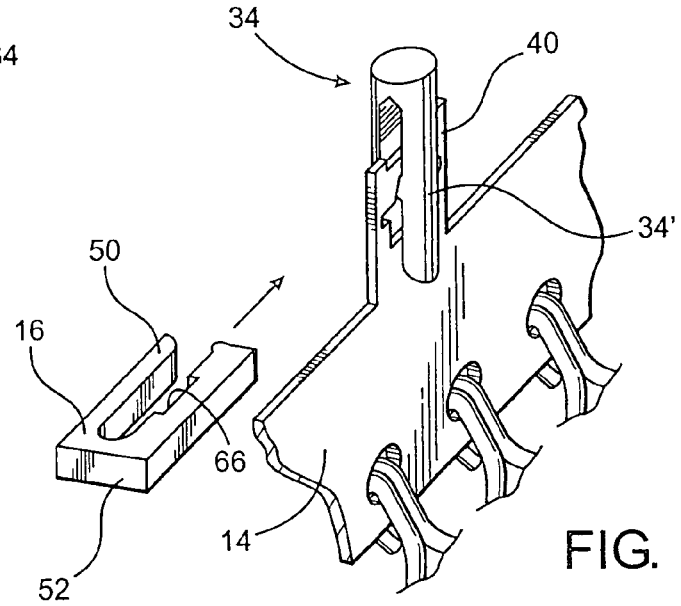
FIG. 17 is a perspective view in partially exploded form of the retaining clip and support plate in association with the connecting portion of FIG. 16.
Figure 18:
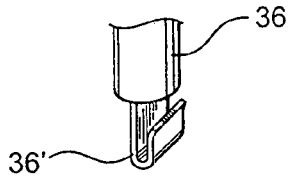
FIG. 18 is yet another structural modification of a connecting portion with which the retaining clip and support plate of the present invention may be utilized.
Figure 19:
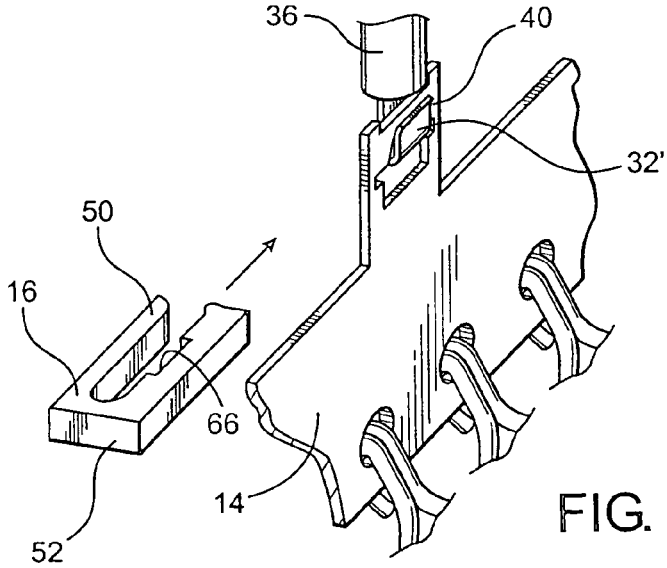
FIG. 19 is a perspective view in partial cutaway and exploded form disclosing the retaining clip and support plate of the present invention associated with the connecting portion of FIG. 13.
Figure 20:
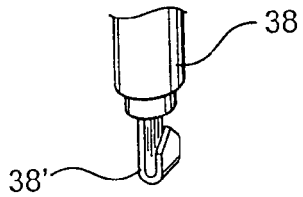
FIG. 20 is yet another structural variation of a connecting portion with which the retaining clip and support plate of the present invention may be utilized.
Figure 21:
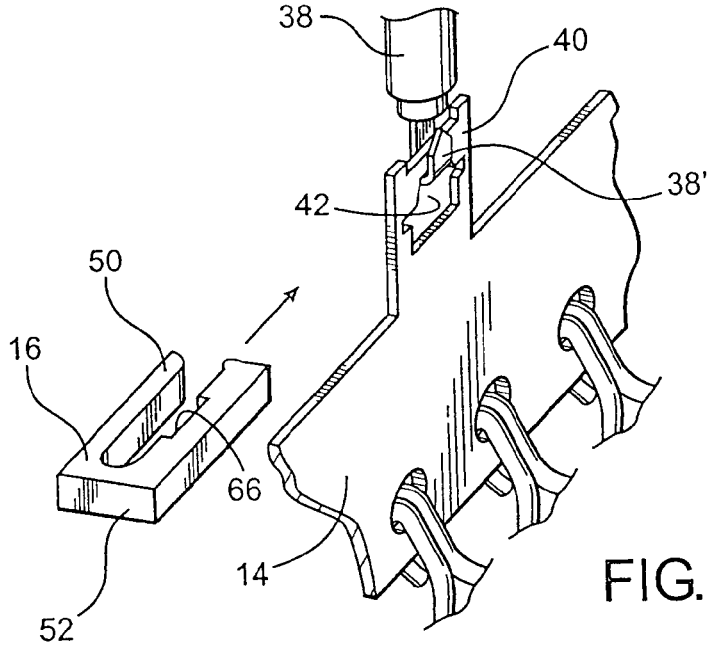
FIG. 21 is a perspective view in partial cutaway of the retaining clip and support plate of the present invention in association with the connecting portion as shown in FIG. 20.

Similarly, FIGS. 16 and 17 represent yet another, structurally distinguishable connecting portion 34 having an engaging portion 34'. Interior projections 35 pass into the mounting aperture 42 for supporting attachment of the support plate 14 in the intended suspended orientation. As with the previously described embodiments, the retaining clip 16 is forced over and in surrounding, clamping relation to the connecting portion 34 as the connecting portion 34 passes through the access opening 56. As also described with the previously noted embodiments the recessed configuration 66 of the interior surface segment 62 receives at least one exposed part of the connection portion 34 such as at or about the engaging member 34'.

With primary reference to FIGS. 18 through 21, additional structurally distinguishable connecting portions 36 and 38 are respectively disclosed in FIGS. 18, 19 and 20, 21. Each of the connecting portions 36 and 38 include engaging members 36' and 38' respectively which pass through the mounting aperture 42 of the mounting finger 40. Once the support plate 14 is supported in its intended, suspended orientation, the retaining clip 16 is forced over and in surrounding, clamping engagement with the respective connecting portions 36 and 38 in a manner which retains the respective engaging members 36' and 38' within the recessed configuration 66 of the surface segment 62.

Figure 22:
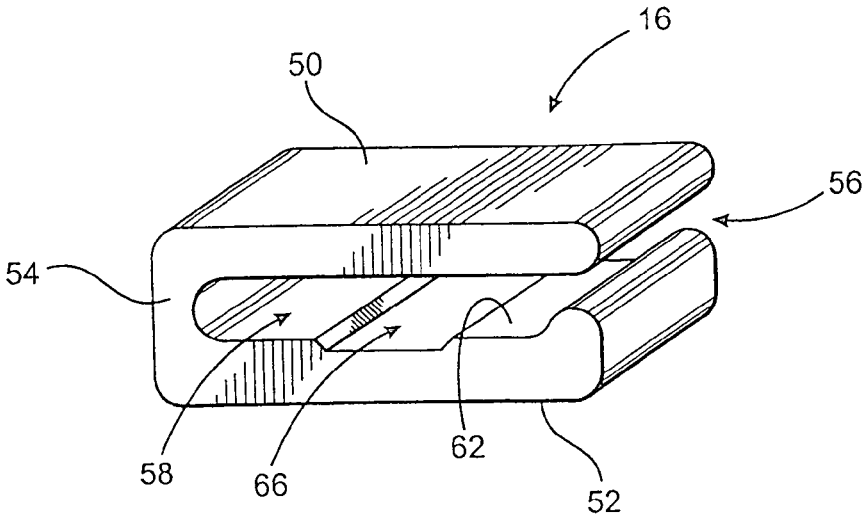
FIG. 22 is a detailed view in perspective of the retaining clip of the present invention.

With reference to FIG. 22 it is emphasized that the recessed surface configuration 66 could be formed on the opposite surface segment 64 (see FIG. 4) rather than surface segment 62. As yet another preferred embodiment the recessed surface segment 66 could be formed on both of the surface segments 62 and 64 as well as on other portions of the interior surface 60 within the open interior 58 of the retaining clip 16. Also, it is emphasized that the retaining clip 16 can be mounted in retaining engagement with the connecting portions 30, 32, 34, 36, 38, etc, from either side thereof rather than only the one side indicated by the directional arrows of FIGS. 11, 17, 19, and 21.

Accordingly, the retaining assembly of the present invention comprising the support plate 14 and the retaining clip 16 is readily adaptable for use in combination with a number of vertical blind assemblies and/or equivalent structures used to support curtain segments rather than the louvers 10 wherein any number of commercially available, conventional or even customized connecting portions 30, 32, 34, 36, 38, etc. may be utilized to support and suspend the respective louvers (or curtain segments) from appropriate carrier assemblies or other operative components of the header assembly 12 as set forth above.

As set forth in greater detail hereinafter the retaining assembly of the present invention may further include additional preferred embodiments which include structural modifications of the retaining clip 16 as described above with reference to FIGS. 1 through 22 above. It is emphasized, that while the retaining assembly of the present invention has been described in the above noted Figures specifically with reference to retaining clip 16, the additional preferred embodiments of the retaining clips 16' and/or 16" can be substituted therefore.

Figure 23:
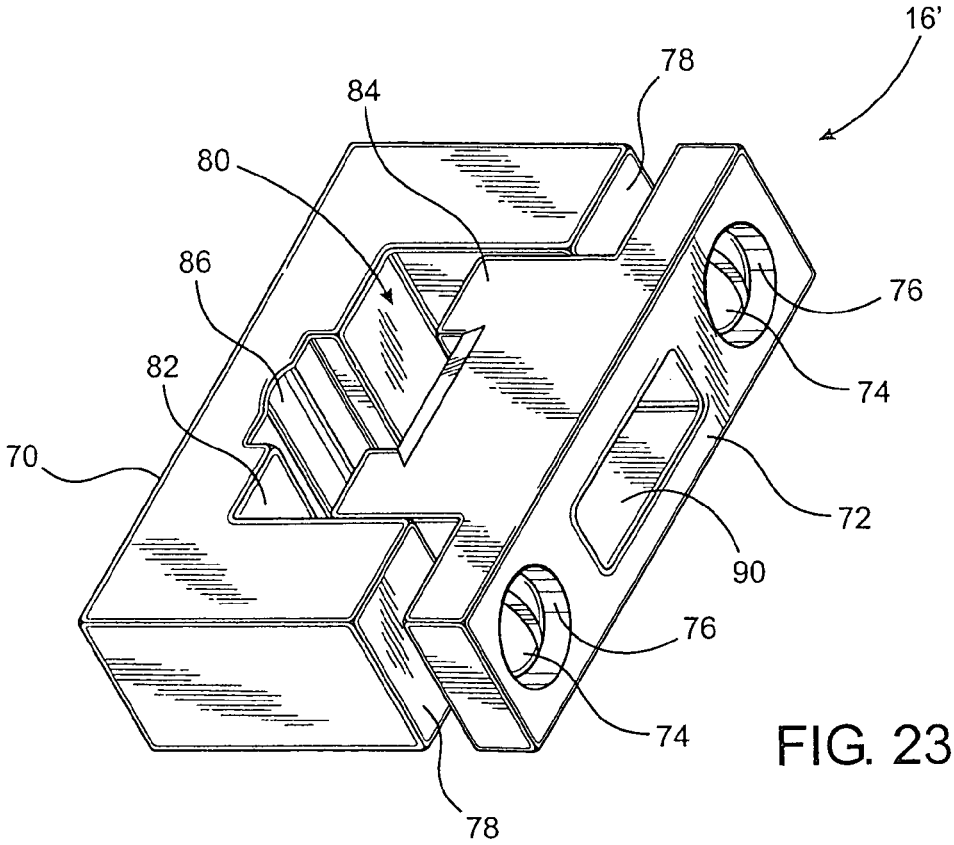
FIG. 23 is a perspective view of yet another preferred embodiment of a retainer clip of the present invention.
Figure 24:
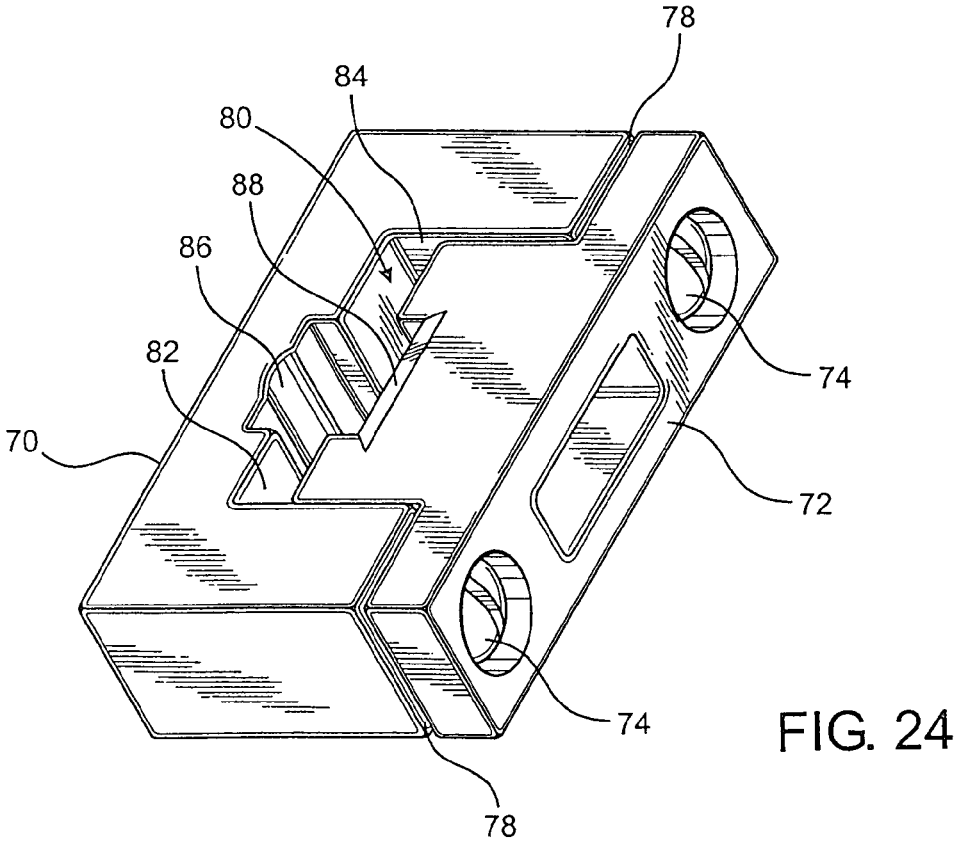
FIG. 24 is a perspective view of the embodiment of FIG. 23 in a closed, operative position.

With primary reference to FIGS. 23 and 24, the retaining clip 16' comprises at least two clip portions more specifically defined as a first clip portion 70 and a second clip portion 72 which are connected together to assume the closed, operative position of FIG. 24. Interconnection of the first and second clip portions 70 and 72 may be accomplished by at least one but preferably two connectors 74 which may include an externally threaded configuration. As such, each of the connectors 74 pass through openings 76 and into aligned channels or openings formed in the mating portions 78 of the first clip portions 70. It should be further noted that the first and second clip portions 70 and 72 are cooperatively dimensioned and configured so as to define an open interior generally indicated as 80 there between. As is clearly evident, the open interior 80 differs from the open interior 58 of the embodiment of FIGS. 3 through 6 by having a substantially closed periphery bounded and collectively defined by corresponding parts of the first and second clip portions 70 and 72. However, as with the open interior 58, the open interior 80 is dimensioned and configured to receive any of a variety of different types of connecting portions 30 therein.

Similarly, the open interior 80 has an interior surface extending continuously about its periphery and including at least two substantially opposed surface segments 82 and 84 respectively formed on the first and second clip portions 70 and 72. At least one of the surface segments 82 at least partially defines a recessed configuration as at 86 which facilitates receipt, retention and clamping engagement with corresponding parts of the connecting portion 30 as described with regard to the use of the clip 16 of the embodiment of FIGS. 3 through 6. In addition, surface segment 84, associated with the second clip portion 72, may also at least partially define the recessed configuration of the interior surface. More specifically, recess or indentation 88 is formed on the interior surface of the second clip portion 84 and is dimensioned and disposed to further facilitates the receipt, retention and clamping engagement of the connecting portion within the open interior 80. As is evident such clamping engagement is accomplished upon the first and second clip portions 70 and 72 being connected in the closed, operative position of FIG. 24.

Other structural features of the retainer clip 16' includes one or more cavities as at 90 formed in at least the second clip portion 72 for purposes of facilitating the manufacturer thereof and reducing weight and/or material utilized for the formation of the retaining clip 16'.

Figure 25:
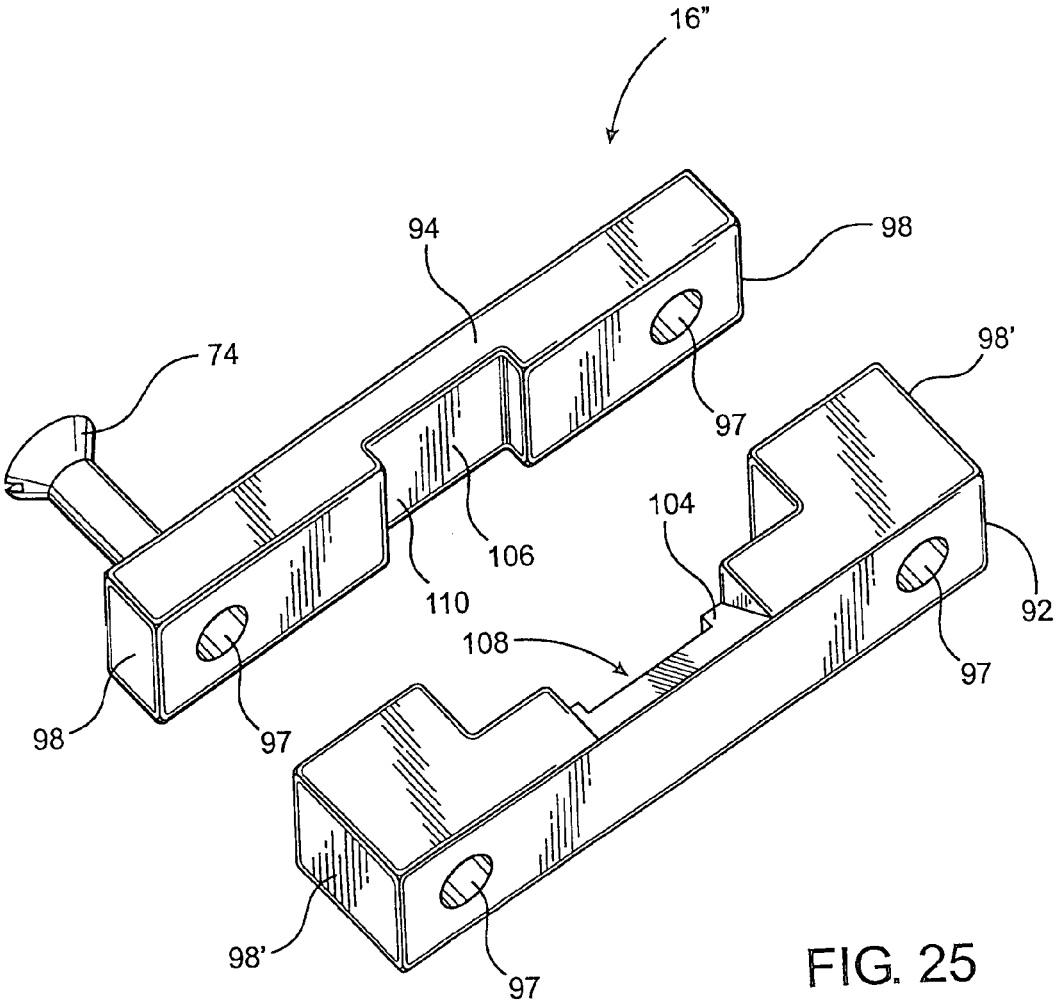
FIG. 25 is a perspective view in exploded form of yet another preferred embodiment of a retainer clip structure.
Figure 26:
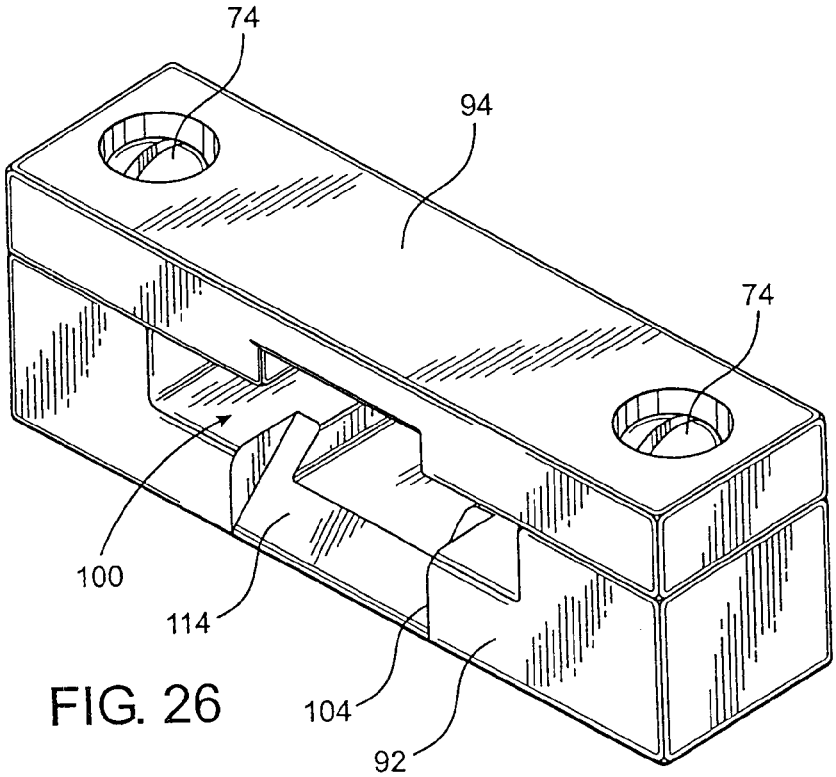
FIG. 26 is a perspective view of the embodiment of FIG. 25 in a closed, operative position.
Figure 27:
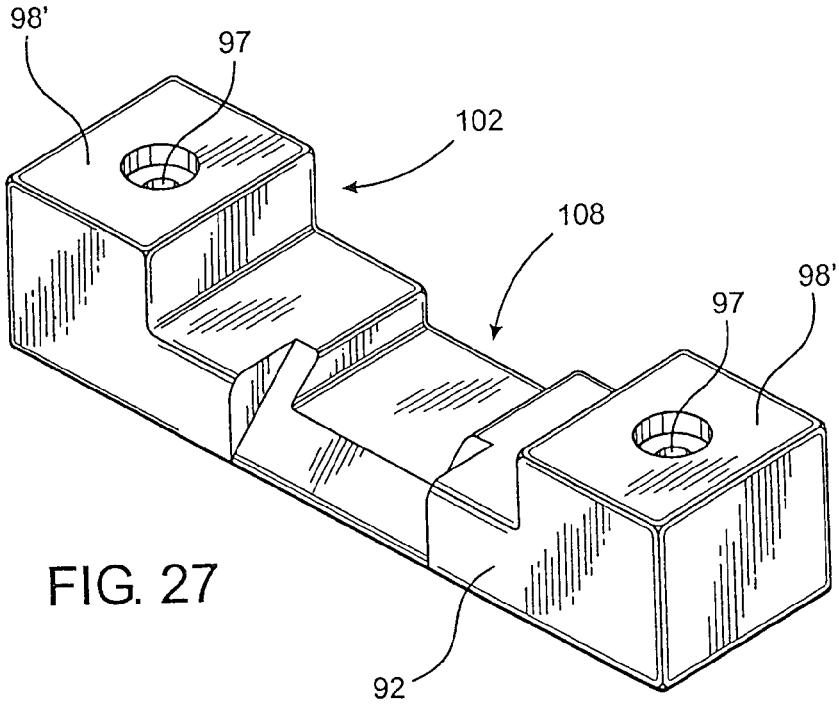
FIG. 27 is a perspective view of one of two clip portions of the retainer clip of the embodiment of FIGS. 25 and 26.

FIGS. 25 through 27 disclose yet another preferred embodiment of the retaining clip 16" As represented, the retaining clip 16" resembles the retaining clip 16' and is clearly distinguishable from the retaining clip 16 by virtue of it comprising at least two clip portions. More specifically, retaining clip 16" comprises a first clip portion 92 and a second clip portion 94. The first and second clip portions 92 and 94 are removably connected to one another by the provision of at least one, but preferably two connectors 74 passing through aligned channels or openings 97 in the mating portions 98 and 98' of the first and second clip portions 94 and 97.

When the first and second clip portions 92 and 94 are in the closed, operative position of FIG. 26, an open interior generally indicated as 100 is formed there between. Similar to the embodiment of FIGS. 23 and 24, the open interior 100 includes a closed peripheral configuration and interior surface 102. The interior surface comprises substantially opposed interior surface segments 104 and 106 respectively formed on first and second clip portions 92 and 94. In addition, the interior surface 102 comprises a recessed configuration as at 108. However, in this preferred embodiment of the retainer clip 16", the recessed configuration may be further defined by a second recess or indented area 110. The recessed areas or portions 108 and 110 are disposed in substantially opposing relation to one another so as to receive, retain and be disposed in clamping engagement with opposite, corresponding parts of the connecting portion as at 30 as described with reference to the embodiments of FIGS. 1 through 22.

Additional structural features of the preferred embodiment of the retaining clip 16" of FIGS. 25 through 27 include a beveled area 114 disposed in communicating relation with the recessed area 108. The beveled area 114 is provided to further facilitate receipt, retention and clamping engagement with connecting portions

What is claimed is:

1. An assembly structured to securely retain a louver of a vertical blind assembly in an operative orientation, said assembly comprising:

a) a connecting portion of said carrier assembly a support plate supported in depending relation to a carrier assembly of the vertical blind assembly, by said connecting portion b) said support plate located at an upper end of the louver in supporting relation thereto, and c) a retaining clip is disposed on opposite sides of said support plate in sandwiching engagement with said connecting portion of the carrier assembly.

2. An assembly as recited in claim 1 wherein said retaining clip is removably disposed relative to said support plate and the connecting portion.

3. An assembly as recited in claim 2 wherein said retaining clip is structured and configured to at least partially surround the connecting portion.

4. An assembly as recited in claim 1 wherein said support plate includes a stabilizing structure mounted adjacent the connecting portion and cooperatively disposed to restrict relative lateral displacement of said support plate and the connecting portion.

5. An assembly as recited in claim 4 wherein said stabilizing structure comprises at least one stop number disposed in engagement with a part of the connecting portion supportingly engaging said support plate.

6. An assembly as recited in claim 4 wherein said support plate comprises a mounting aperture disposed and dimensioned to receive the connecting portion there through; said stabilizing structure comprising at least two stop members each disposed adjacent a periphery of said mounting aperture in movement restricting relation to the connecting portion.

7. An assembly structured to securely retain a louver of a vertical blind assembly in an operative orientation, said assembly comprising:

a) a support plate secured adjacent an upper end of the louver and attached in supported relation to a connecting portion of a carrier assembly of the vertical blind assembly, b) said support plate including a stabilizing structure mounted adjacent the connecting portion and cooperatively disposed to restrict relative lateral displacement of said support plate and the connecting portion, c) a one piece retaining clip including an open interior and an interior surface, said interior surface disposed in at least partially surrounding relation and clamping engagement with the connecting portion, and d) at least a portion of said interior surface having a recessed configuration disposed in retaining relation to the connecting portion.

8. An assembly structured to securely retain a louver of a vertical blind assembly in an operative orientation, said assembly comprising:

a) a support plate secured adjacent an upper end of the louver and attached in supported relation to a connecting portion of a carrier assembly of the vertical blind assembly, b) said support plate including a stabilizing structure mounted adjacent the connecting portion and cooperatively disposed to restrict relative lateral displacement of said support plate and the connecting portion, c) a retaining clip including an open interior and an interior surface, said interior surface at least partially disposed in clamping engagement with the connecting portion, d) at least a portion of said interior surface having a recessed configuration disposed in retaining relation to the connecting portion, and e) said interior surface comprising at least two substantially opposed surface segments, said recessed configuration formed on each of said surface segments in receiving engagement with substantially opposite parts of said connecting portion.

9. An assembly as recited in claim 8 wherein at least one of said surface segments comprises a beveled area formed thereon and disposed in communication with said recessed configuration.

10. An assembly as recited in claim 8 wherein said retaining clip comprises at least two clip portions connected together into clamping engagement with the connecting portion.

11. An assembly as recited in claim 10 wherein each of said surface segments is formed on a different one of said clip portions in substantially opposed relation to one another.

12. An assembly as recited in claim 10 wherein said clip portions are removably connected to one another.

13. An assembly as recited in claim 8 wherein said stabilizing structure comprises at least one stop member disposed in movement restricting relation to a part of the connecting portion supportingly engaging said support plate.

14. An assembly structured to securely retain a louver of a vertical blind assembly in an operative orientation, said assembly comprising:

a) a connecting portion of said carrier assembly a support plate supported in depending relation to a carrier assembly of the vertical blind assembly by said connecting portion, b) said support plate located at an upper end of the louver in supporting relation thereto, and c) a retaining clip disposed adjacent said support plate and comprising a first clip portion and a second clip portion connected together into clamping engagement with said connecting portion of the carrier assembly.

15. An assembly as recited in claim 14 wherein said retaining clip comprises at least one connector disposed in interconnecting relation to both said first and second connecting portions.

16. An assembly as recited in claim 14 wherein said retaining clip is disposed in sandwiching engagement with the connecting portion on opposite sides of said support plate.

17. An assembly as recited in claim 14 wherein said retaining clip comprises an open interior having a substantially closed periphery defined by both said first and second clip portions.

18. An assembly as recited in claim 17 wherein said retaining clip further comprises an interior surface disposed within said open interior and structured to assume a clamping engagement with the connecting portion.

19. An assembly as recited in claim 18 wherein said interior surface comprises at least two surface segments each formed on a different one of said first and second clip portions and disposed in engaging relation with substantially opposing parts of the connecting portion.

20. An assembly as recited in claim 19 wherein said retaining clip is dimensioned and configured to retain the connecting portion within said open interior in sandwiched relation between said two surface segments and said first and second clip portions.

21. An assembly as recited in claim 14 wherein said first and second clip portions are removably connected to one another and disposed on opposite sides of said support plate and in sandwiching relation to the connecting portion.

22. An assembly as recited in claim 21 wherein said retaining clip comprises an open interior and an interior surface disposed therein; at least a portion of said interior surface comprising a substantially recessed configuration disposed in retaining engagement with a corresponding part of the connecting portion.

23. An assembly as recited in claim 22 wherein said interior surface comprises a plurality of surface segments disposed in spaced relation to one another, at least one of said surface segments including at least a portion of said recessed configuration disposed and dimensioned to receive the corresponding part of the connecting portion therein.

24. An assembly structured to securely retain a louver of a vertical blind assembly in an operative orientation, said assembly comprising:

a) a support plate secured adjacent an upper end of the louver and attached in supported relation to a connecting portion of a carrier assembly of the vertical blind assembly, b) said support plate including a stabilizing structure mounted adjacent the connecting portion and cooperatively disposed to restrict relative lateral displacement of said support plate and the connecting portion, c) a retaining clip including an open interior and an interior surface, said interior surface at least partially disposed in clamping engagement with the connecting portion, d) at least a portion of said interior surface having a recessed configuration disposed in retaining relation to the connecting portion, and e) said support plate comprising a mounting aperture disposed and dimensioned to receive the connecting portion therethrough, said stabilizing structure comprising at least two stop members each disposed adjacent a periphery of said mounting aperture in movement restricting relation to the connecting portion.

* * * * *